US006111970A

United States Patent [19]

Voishvillo et al.

[11] Patent Number: 6,111,970

[45] Date of Patent: Aug. 29, 2000

[54] SUSPENSION FOR HIGH POWER PLEATED RIBBON TRANSDUCER

[75] Inventors: Alexander Voishvillo, Simi Valley; Laszlo Megyeri, Newbury Park, both of Calif.

[73] Assignee: Cerwin-Vega, Inc., Simi Valley, Calif.

[21] Appl. No.: 09/045,072

[22] Filed: Mar. 20, 1998

Related U.S. Application Data

[63] Continuation of application No. PCT/US97/20537, Nov. 7, 1997.

[60] Provisional application No. 60/029,550, Nov. 8, 1996.

[51] Int. Cl.[7] ..... H04R 25/00

[52] U.S. Cl. ..... 381/398; 381/399; 381/408; 381/431

[58] Field of Search ..... 381/398, 408, 381/423, 431, 399, FOR 153, FOR 156, FOR 162, FOR 163

[56] References Cited

U.S. PATENT DOCUMENTS 3,832,499 8/1974 Heil ..... 381/408

5,325,429 6/1994 Smiley ..... 381/431

*Primary Examiner*—Huyen Le

*Attorney, Agent, or Firm*—Fulbright & Jaworski L.L.P.

[57] ABSTRACT

An electro-dynamic acoustic transducers has a pleated diaphragm in which an accordion-like alternating movement of the adjacent pleats is perpendicular to the radiation (acoustic) axis of the transducer. Formed metal combs having teeth in the spaces between at least some of the folds provide a precise corrugation and a reliable mechanical attachment between the diaphragm and the frame, with providing better thermal transfer from the diaphragm to the frame. The frame is preferably constructed from a material having high thermal conductivity (such as aluminum) for better heat-transfer and additional heat-dissipation. At least one of the metal combs is resiliently mounted to the frame by a spring, or by means of an elastic or pneumatic mechanism. This enables the diaphragm to remain under tension, counteracting any rippling that might result from the thermal expansion of the dielectric substrate and conductive strands within the frame. A "framed ladder" of heat-conducting bars may be attached to the diaphragm and frame to facilitate heat dissipation from the diaphragm to the frame.

6 Claims, 9 Drawing Sheets

SUSPENSION FOR HIGH POWER PLEATED RIBBON TRANSDUCER

CLAIM TO PRIORITY

This application is based on, and claims priority from, U.S. Provisional Application No. 60/029,550 filed Nov. 8, 1996, and continuation of PCT/US97/20537 filed Nov. 7, 1997.

TECHNICAL FIELD OF THE INVENTION

The present invention relates generally to electrodynamic acoustic transducers, and more particularly to a transducer having a pleated diaphragm in which an accordion-like alternating movement of the adjacent pleats is perpendicular to the radiation (acoustic) axis of the transducer.

BACKGROUND OF THE INVENTION

U.S. Pat. No. 3,832,499 (Oscar Heil) discloses an electroacoustic transducer in which a conductor is arranged in a meander pattern on at least one side of a flexible diaphragm, such that the current in adjacent conductive strands flows in opposite directions. The flexible diaphragm is pleated or corrugated in a suitable jig such that when the corrugated diaphragm is placed in a magnetic field oriented in a front to rear axis with electrical current flowing perpendicular to the magnetic field in one direction in a given fold and in an opposite direction in an adjacent fold, the adjacent folds are alternately displaced to the right and to the left along the third perpendicular axis. The air spaces between adjacent folds facing one side of the diaphragm are expanded while the air spaces on the other side are contracted. After the pleats have been formed, the assembly is tempered and affixed at either end. The finished corrugated unit is then cemented inside a plastic frame thereby forming an assembly which may be inserted and removed from a slotted space inside a magnetic structure. As the Heil patent indicates, having two sets of conductors, one on each side of the diaphragm, doubles the force. Additional embodiments may have two or more conductive strands arranged adjacently on each half pleat on a single side of the diaphragm.

A two-part article in Speaker Builder (March and April 1982) by Kenneth Rauen discloses alternate designs for the diaphragm of a horn loaded "Heil Air Motion Transformer" ("AMT"), based in part on techniques previously published by Neil Davis (Audio Amateur, February 1977), in which a razor blade was used to cut the meandering conductor from a 1 mil layer of aluminum foil. In one embodiment the meandering conductor was sandwiched between two 1 mil layers of polyethylene with rubber cement. In another embodiment, the meandering conductor was fastened to a 0.5 mil layer of polyethylene and covered with a vinyl coating. Stiffeners at either end of the diaphragm were epoxied into aluminum frames, and a screw operated tension block at one end of the frame was used to slightly stretch the diaphragm after the epoxy had set (but not to the point where the diaphragm was "noticeably taut").

Another, presently preferred, AMT design is described and claimed in an unpublished commonly assigned PCT application entitled IMPROVED HORN LOADED PLEATED RIBBON HIGH FREQUENCY ACOUSTIC TRANSDUCER WITH SUBSTANTIALLY UNIFORM COUPLING, filed on Nov. 6, 1997 and hereby incorporated in its entirety by reference.

SUMMARY OF THE INVENTION

In accordance with one aspect of the present invention, the prior art stiffener strips at either end of the corrugated diaphragm are replaced or supplemented with formed metal supports having fingers longitudinally extending into the spaces between at least some of the folds, thereby not only providing a more precise corrugation and a more reliable mechanical attachment between the diaphragm and the frame, but also providing better thermal transfer from the diaphragm to the frame.

The frame itself, unlike the previous plastic design, is preferably constructed from a material having high thermal conductivity (such as aluminum) for better heat-transfer and additional heat-dissipation.

The diaphragm preferably includes enlarged top and bottom margins which are rigidly attached to the fingers of respective top and bottom supports, with the conductors being widened in the vicinity of the fingers to provide greater thermal conductivity between the diaphragm and the frame.

In accordance with another aspect of the present invention, at least one of the metal supports is resiliently mounted to the frame by a spring, or by means of an elastic or pneumatic mechanism. This enables the diaphragm to remain under tension, counteracting any rippling that might result from the thermal expansion of the dielectric substrate and conductive strands within the frame.

In accordance with yet another aspect of the present invention, a "framed ladder" of heat-conducting bars is attached to the diaphragm and frame with an elastomeric adhesive to facilitate heat dissipation from the diaphragm to the frame.

DETAILED DESCRIPTION OF THE INVENTION

Figure 1:
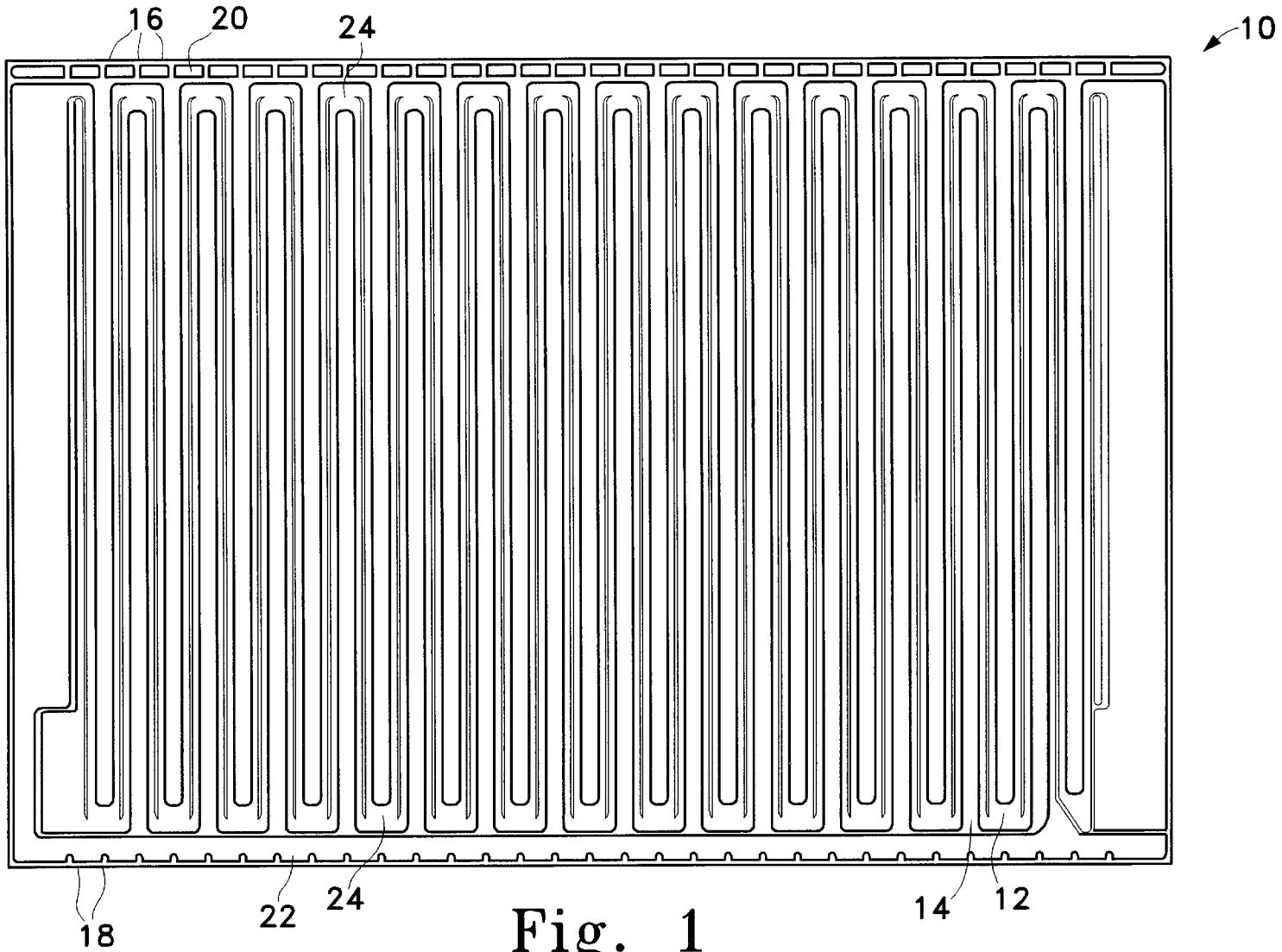
FIG. 1 shows a transducer diaphragm before any pleats have been formed.

As shown in FIG. 1, the transducer diaphragm 10 is preferably fabricated by etching a double meander pattern 12 into a conductive metallic layer (for example, a 2 mill thick layer of aluminum or copper) that has been fused with a flexible dielectric substrate 14 (for example a 0.5 mil thick film of Kapton® by Dupont). The gaps 16 and notches 18 at the top and bottom ends facilitate the folding of the diaphragm into its final pleated (corrugated) structure (see FIGS. 4 & 5). The upper and lower strips 20, 22 cooperate with the enlarged ends 24 of each segment to maintain the diaphragm in its folded configuration during assembly and to provide electrical connection between the adjacent conductors of the same vibrating surface. The exposed surface of the conductive meander 12 is preferably covered with a second insulative coating to prevent short circuits between segments or with any surrounding conductive structures. In other embodiments (not shown) a similar meander pattern may be formed on the other side of the substrate, thereby doubling the effective length, or one side may include a number of parallel conductors which are interleaved with a similar array on the other side, with the two arrays being interconnected to provide currents flowing in opposing directions in adjacent folds.

Figure 2:
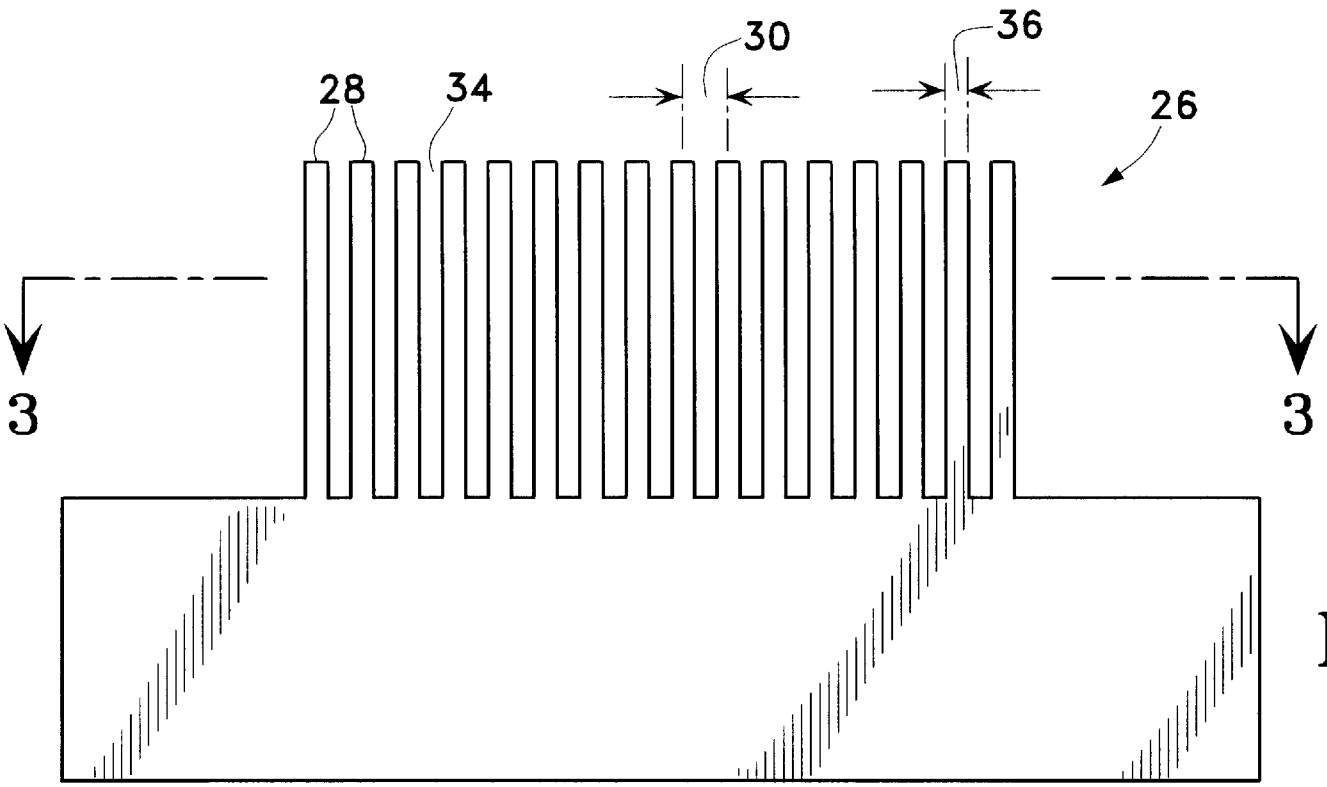
FIG. 2 is a plan view of a comb suitable for supporting one end of a transducer diaphragm.
Figure 3:
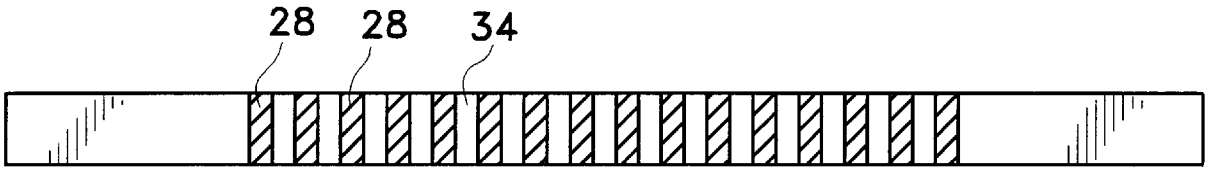
FIG. 3 is a cross section of the toothed area of the comb of FIG. 2.
Figure 4:
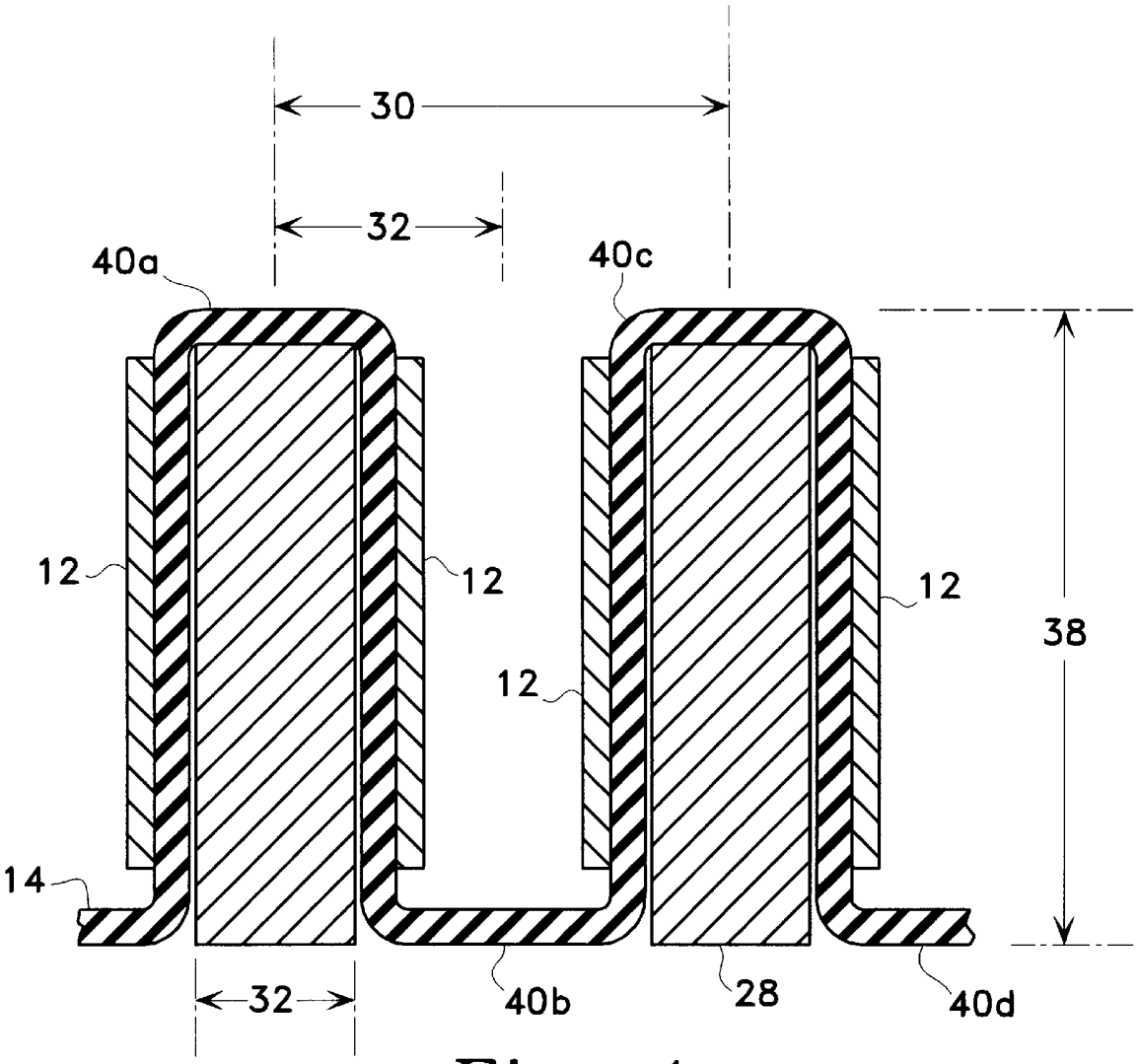
FIG. 4 shows how the individual pleats of a transducer diaphragm may be mounted on the respective teeth of the comb of FIGS. 2 & 3.

Referring now to FIGS. 2,3 and 4, a conductive support in the form of a comb 26 with a number of teeth-like fingers 28. The center to center spacing 30 between adjacent teeth is equal to twice the nominal center to center spacing 32 between adjacent pleats of the transducer diaphragm, and the open space 34 between adjacent teeth (for example, 36 mils) is preferably sufficiently larger than the width 36 of each tooth (for example, 30 mils), such that when the diaphragm 10 is pleated and the side with the substrate 14 is in direct contact with the fingers (as shown in FIG. 4), the center-to-center spacing of the metal conductive strands 12 on two adjacent surfaces is equal to the nominal center-to-center distance 32 between the pleats.

Figure 5:
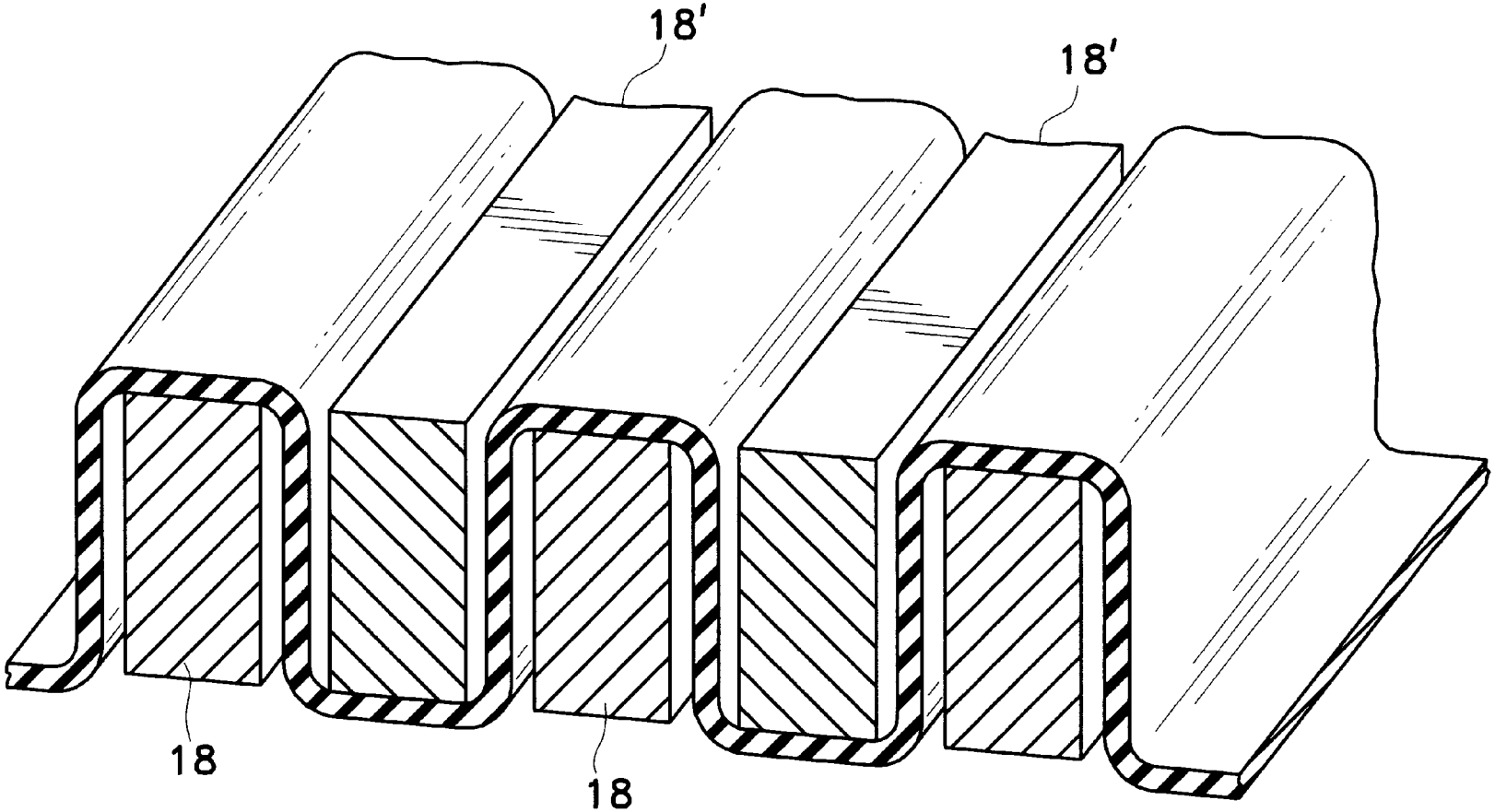
FIG. 5 shows an alternative embodiment in which the pleated ends of the diaphragm are held between a pair of interdigitated combs.

In the alternate embodiment of FIG. 5, a second comb 18' is inserted from the other side, with the spacing between the two combs being only slightly greater than the combined thickness of the various layers of the diaphragm.

Again referring to FIG. 4, the depth of each fold 38 is determined by the thickness of the comb and may be approximately equal to three times the nominal center to center spacing of the folds 32, although lower or higher ratios of pleat depth to pleat width ratio (for example, 2:1 or 4:1) result in a smaller or larger diaphragm area and/or a longer or shorter movement and a corresponding increased or reduced effective mass factor, and may therefore be preferred for particular applications requiring higher output levels or a wider frequency range.

Preferably, the comb 18 is formed of a material with good thermal conductivity that is easily cast and/or machined, such as aluminum. Any exposed sharp edges are preferably "broken" (slightly rounded or beveled) before the diaphragm 10 is inserted, in order to prevent cutting or abrading of the insulative film 14 and possible shorting or open circuiting of the aluminum conductor 12. Assuming that the flexible substrate is a Kapton® film, it may be adhesively secured to the respective fingers using a conventional cynoacrylate adhesive such as Rite-Lock™ 2500 609081. Because of the increased contact area compared to the prior art, the joint between the ends of the pleated diaphragm and the frame is more mechanically sound and capable of withstanding tension.

Figure 6:
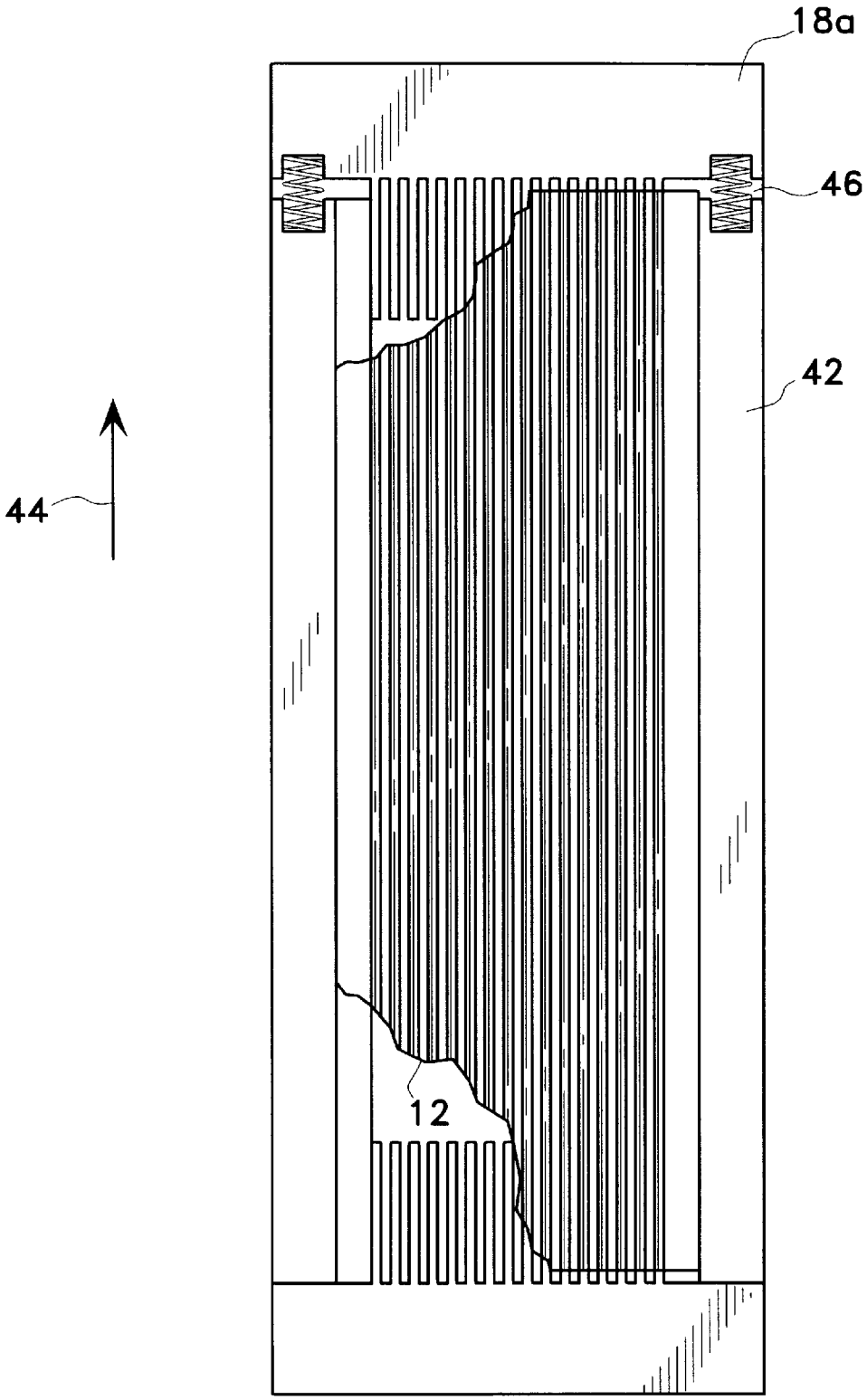
FIG. 6 shows an exemplary resilient mounting mechanism whereby the comb of FIGS. 2 & 3 are attached to the frame in order to apply tension to the diaphragm.

Reference should now be made to FIG. 6, which shows an exemplary mechanism for tensioning the individual pleats 40*a*, 40*b*, 40*c*, 40*d* of the diaphragm by flexibly securing one of the combs 18*a* to the frame 42 such that it may move along a longitudinal axis 44 in the direction of the individual pleats, thereby compensating for dimension variations caused by thermal expansion of the conductor at high levels of operating power. For example, the upper comb 18*a* may slide longitudinally in a groove at either side of an enlarged top portion (not shown) of the frame 42, and a pair of coil springs 46 disposed between the upper comb and the two sides of the frame urge the comb upwards, thereby applying a tension force in the direction of the longitudinal axis 44 to the pleats of the diaphragm to maintain equidistant separation of the individual pleats. Alternatively, the frame may be constructed in two parts with each comb being fixed to a respect part of the frame or the moveable comb may be slidable inside the frame. In other alternative embodiments, the pair of compression springs 46 may be replaced with other suitable tensioning means such as a leaf spring or a single coil spring or other elastic or pneumatic member in compression or in tension and mounted inside the frame or outside the frame so as to apply a tension force to the diaphragm parallel to the direction of the electrical conductors.

Figure 7:
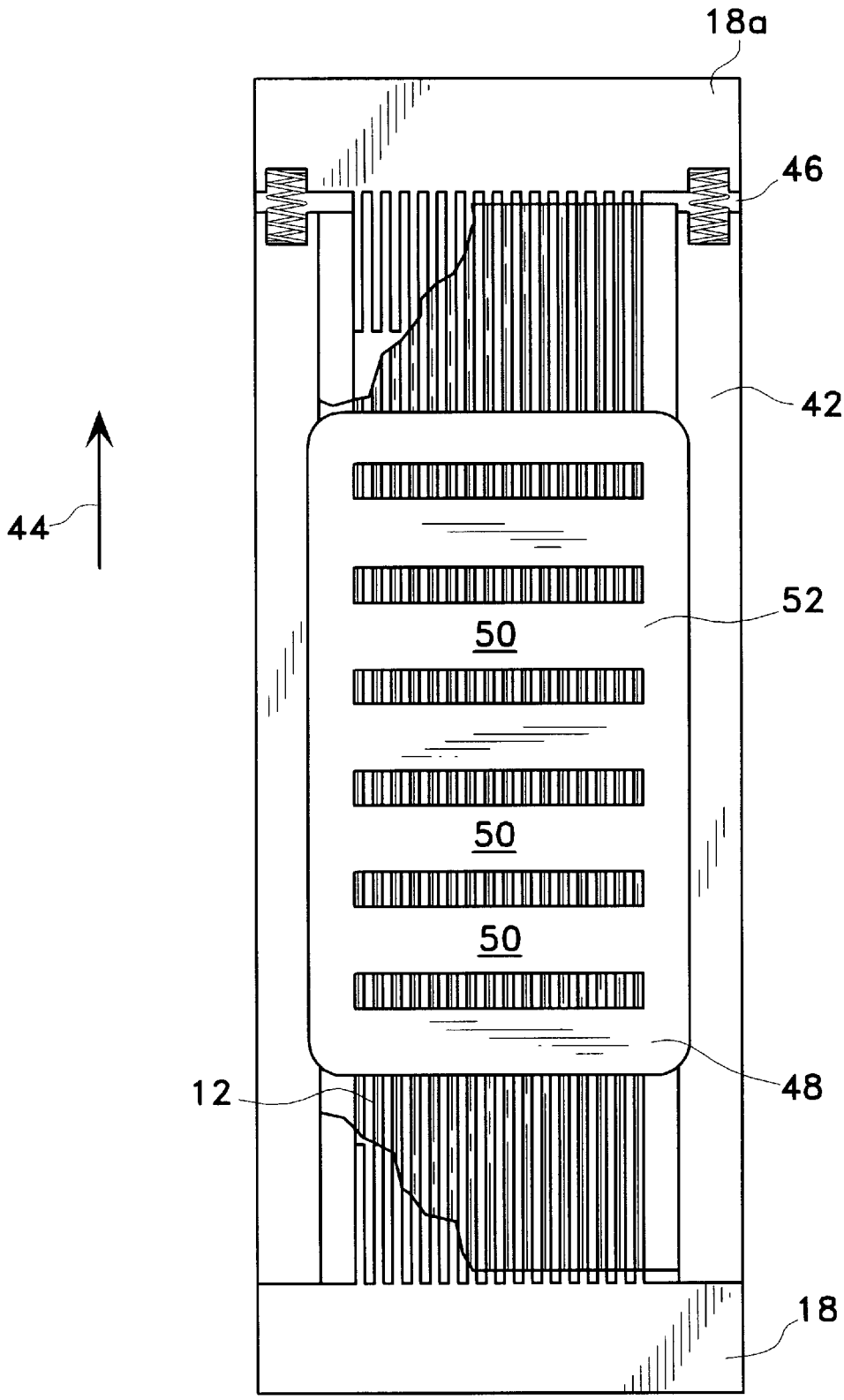
FIG. 7 shows how a framed ladder of metal heat-conducting bars may be attached to the diaphragm and frame by means of a heat-conducting elastomeric adhesive.

FIG. 7 shows a framed ladder 48 composed of a series of horizontal metal heat-conducting bars 50 running perpendicular to the diaphragm's pleats and attached to them with a conductive elastomeric adhesive. The ladder's frame 52 is also attached to the vertical sides 42 of the diaphragm frame, with elastomeric adhesive, but is not affixed at the top and bottom edges of the frame, to allow for heat expansion of the diaphragm. Each bar 50 of the ladder is spaced in such a fashion that when the diaphragm card is registered in an AMT motor similar to that described in the referenced PCT application, the heat-conducting bars align with and contact the corresponding bridge portions of the magnetic pole plate, in between the pole plate's apertures. The points of contact between the ladder and the pole plate are coated with heat-sinking grease to facilitate transfer of heat and to eliminate any vibration between the surfaces.

Figure 8:
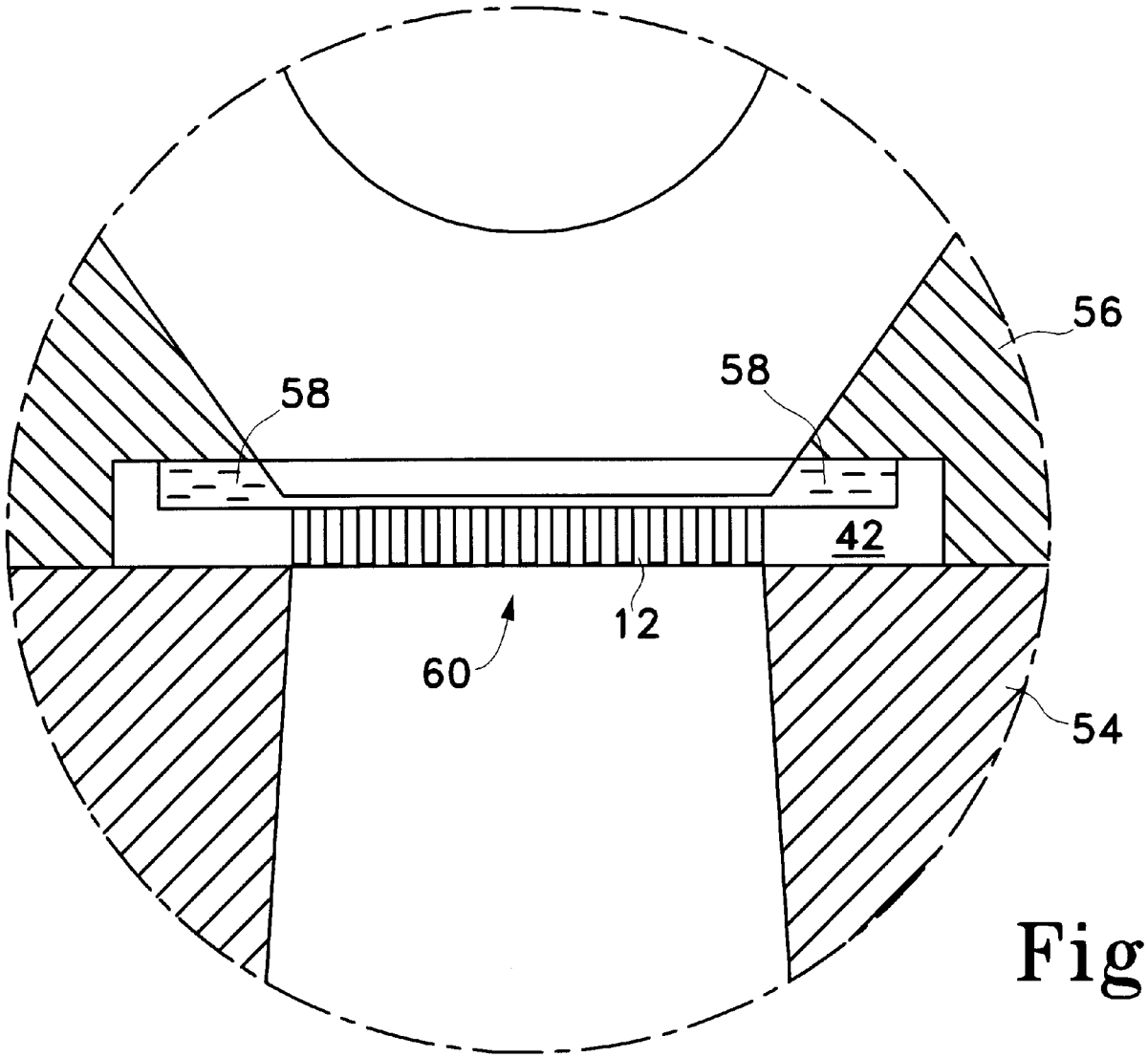
FIG. 8 shows how the frame of FIG. 5 may be secured between the pole plates of a transducer.

FIG. 8 is an enlarged view showing the comb 12 and holder 42 installed between the front and rear pole plates 54, 56 of an AMT motor similar to that described in the referenced PCT application. A strip of foam 58 at either side of the active area 60 of the pleated diaphragm 12 seals its side edges and prevents leakage, while still permitting the diaphragm to expand and contract in length.

Figure 9:
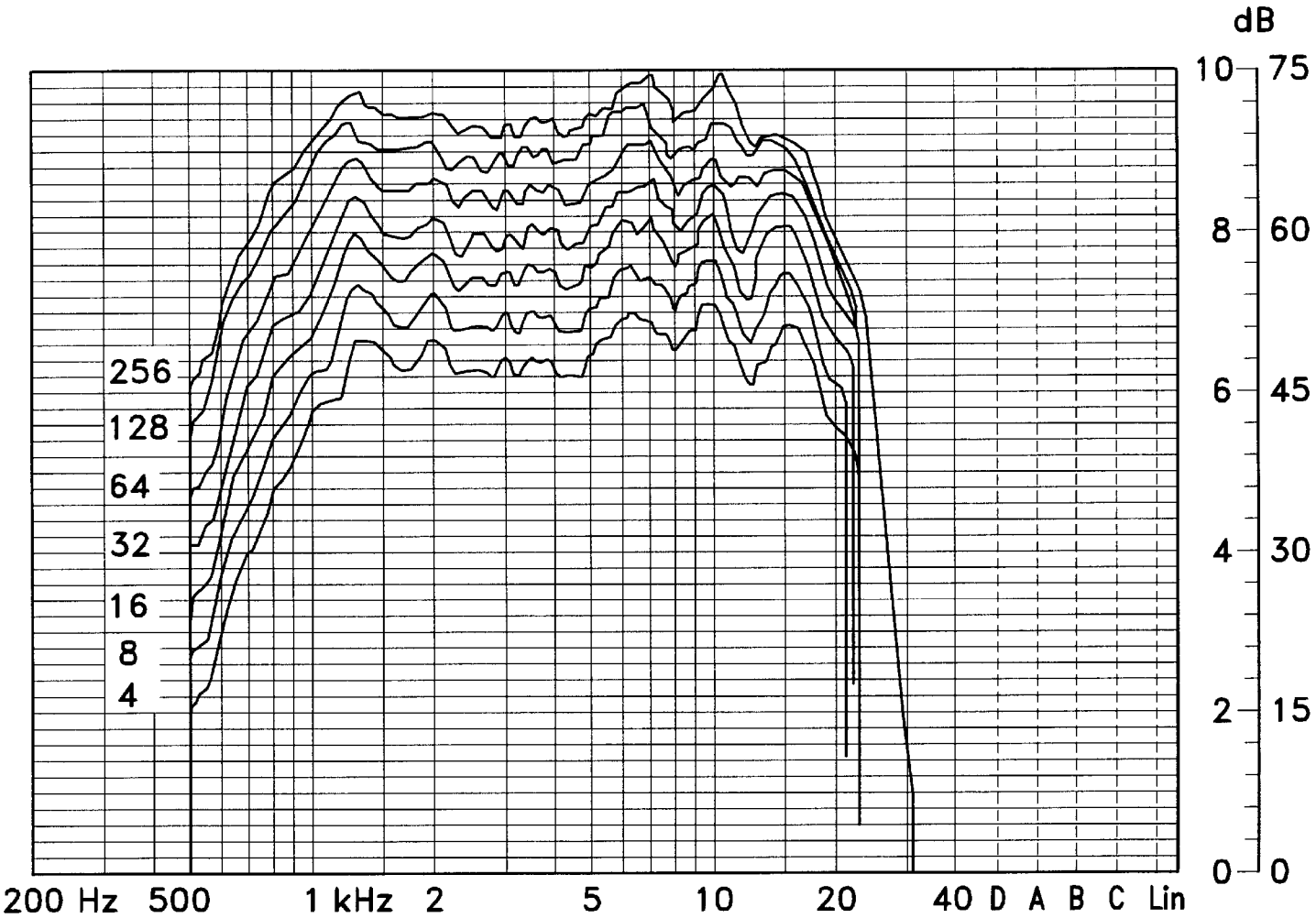
FIG. 9 shows a typical measured frequency response of an exemplary embodiment at various input power levels.
Figure 10A:
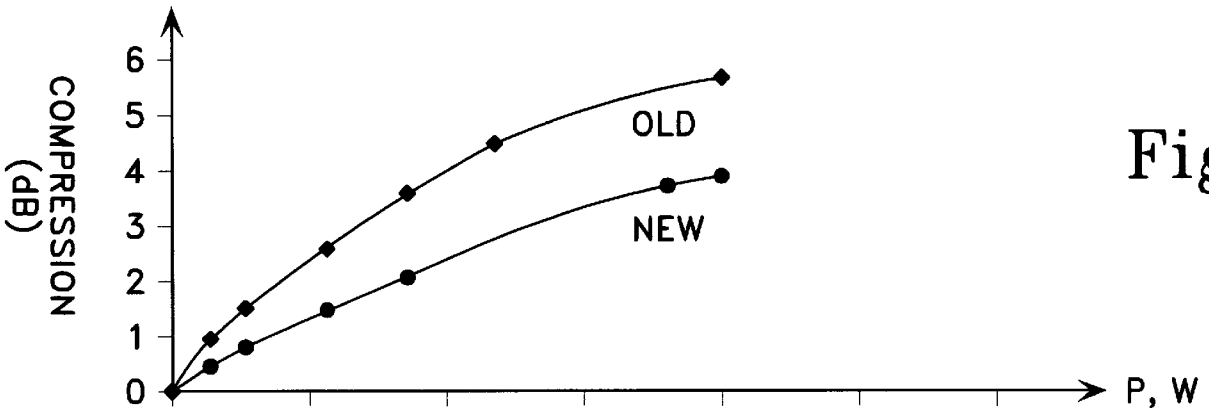
FIGS. 10*a* and 10*b* are graphs contrasting the performance of the present invention with that of the prior art.
Figure 10B:
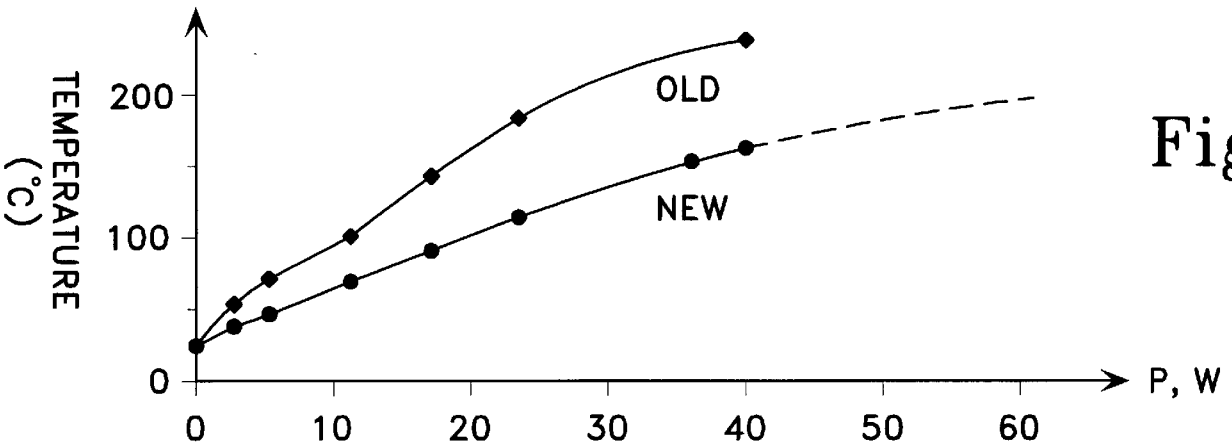

In a practical example, the improved heat dissipation resulted in an approximate 100 degree Celsius temperature decrease at an operating power of 40 W RMS. A further advantageous effect was the reduction in dynamic compression by about 3 dB, which is the result of an increase in thermally-induced electrical resistance in the diaphragm's conductive Layer, FIGS. 10*a* and 10*b*. FIG. 9 shows that each time the input power was doubled, the sound pressure level (SPL) increased proportionally by approximately 3 dB.

Other modifications will be apparent to those skilled in the art. For example, the supporting fingers 18, rather than being in the form of teeth on a comb, could be finger-shaped lands defined by a longitudinal array of grooves machined into an appropriate conductive substrate.

What is claimed is:

1. A transducer diaphragm assembly, comprising:

a frame having a first end and a second end;

a pleated ribbon diaphragm including a plurality of adjacent conductive strands for conducting electrical current along adjacent pleats in opposite directions between the first and second ends of the diaphragm;

a first support secured to the first end of the frame and having a first plurality of fingers extending in a longitudinal direction towards the second end of the frame each finger of the first support being secured at the first end of the diaphragm within a respective pleat;

a second support secured to the second end of the frame, said second support having a second plurality of fingers extending towards the first end of the frame each finger of the second support being secured at the second end of the diaphragm to a respective pleat; and means for urging the first support away from the second support to thereby apply a tension force to the diaphragm in said longitudinal direction;

whereby the pleated ribbon diaphragm remains taut and the geometrical relationship between the pleats is unaffected by any dimensional changes in the ribbon and the conductive strands.

2. The assembly of claim 1 wherein at least one of the supports is slidable relative to its respective end along an axis defined by the pleats, and a spring couples that support to that end.

3. The assembly of claim 1 wherein each end of the diaphragm is attached to a respective support, and the sides of the diaphragm are sealed to the frame to prevent air leakages.

4. The assembly of claim 1, wherein said frame is made of a conductive material.

5. The assembly of claim 4, further comprising a plurality of conductive bars each extending across an active region of the diaphragm intermediate the first and second ends of the frame, in a lateral direction perpendicular to said longitudinal direction;

elastomer means for maintaining each of said conductive bars in contact with each of said pleats; and heat sink means for maintaining each of said conductive bars in contact with said frame, whereby said bars may conduct heat generated in the conductive strands to said conductive frame.

6. The assembly of claim 1, wherein each of said supports has the form of a comb and said fingers are in the form of the teeth of said comb.

* * * * *